US007952605B2

(12) United States Patent
Seo et al.

(10) Patent No.: US 7,952,605 B2
(45) Date of Patent: May 31, 2011

(54) LIGHT SCANNING UNIT ASSEMBLY, ELECTROPHOTOGRAPHIC IMAGE FORMING APPARATUS INCLUDING THE SAME, AND METHOD OF ADJUSTING SCANNING LINE SKEW

(75) Inventors: In-sick Seo, Suwon-si (KR); Dong-ha Choi, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 1722 days.

(21) Appl. No.: 11/178,487

(22) Filed: Jul. 12, 2005

(65) Prior Publication Data

US 2006/0082795 A1 Apr. 20, 2006

(30) Foreign Application Priority Data

Oct. 19, 2004 (KR) ..... 10-2004-0083515

(51) Int. Cl.
*B41J 2/435* (2006.01)

(52) U.S. Cl. ..... 347/263

(58) Field of Classification Search ..... 347/263
See application file for complete search history.

(56) References Cited

U.S. PATENT DOCUMENTS

| | | | | |
|---|---|---|---|---|
| 6,046,759 | A * | 4/2000 | Kim | 347/263 |
| 6,600,504 | B2 * | 7/2003 | Okugawa et al. | 347/152 |
| 7,262,787 | B2 * | 8/2007 | Park | 347/263 |

FOREIGN PATENT DOCUMENTS

| | | | |
|---|---|---|---|
| JP | 11-194281 | | 7/1999 |
| JP | 2001-337283 | | 12/2001 |
| JP | 2004-54146 | | 2/2004 |
| KR | 2000-9240 | A | 2/2000 |
| KR | 2000-10297 | A | 2/2000 |
| KR | 2004-18588 | A | 3/2004 |
| KR | 2004-25520 | A | 3/2004 |

* cited by examiner

*Primary Examiner* — Huan H Tran
(74) *Attorney, Agent, or Firm* — Stanzione & Kim, LLP

(57) ABSTRACT

A light scanning unit assembly, an electrophotographic image forming apparatus including the light scanning unit assembly, and a method of adjusting a scanning line skew. The light scanning unit assembly includes a frame, a primary light scanning unit and at least one secondary light scanning unit each being mounted to the frame to scan a corresponding beam, and a skew adjuster to adjust a scanning line skew of the at least one secondary light scanning unit to equal a scanning line skew of the primary light scanning unit. In the light scanning unit assembly, the skew adjuster includes at least one side to project out from at least one side of the at least one secondary light scanning unit, at least one adjusting screw to connect the at least one side projection with the frame, and at least one elastic member interposed between the at least one side projection and the frame. The scanning line skew adjustment method includes mounting the primary and the at least one secondary light scanning units on the frame and manipulating the at least one skew adjuster such that a scanning line skew of the at least one secondary light scanning unit is equal to a scanning line skew of the primary light scanning unit. The skew adjustment operation includes adjusting the scanning line skew of the at least one secondary light scanning unit to coincide with the scanning line skew of the primary light scanning unit by rotating the at least one adjusting screw.

40 Claims, 7 Drawing Sheets

LIGHT SCANNING UNIT ASSEMBLY, ELECTROPHOTOGRAPHIC IMAGE FORMING APPARATUS INCLUDING THE SAME, AND METHOD OF ADJUSTING SCANNING LINE SKEW

CROSS-REFERENCE TO RELATED APPLICATIONS

This application claims priority from Korean Patent Application No. 2004-83515, filed on Oct. 19, 2004, in the Korean Intellectual Property Office, the disclosure of which is incorporated herein in its entirety by reference.

BACKGROUND OF THE INVENTION

1. Field of the Invention

The present general inventive concept relates to a light scanning unit assembly including a plurality of light scanning units, and more particularly, to a light scanning unit assembly having a skew adjuster to adjust a skew of a plurality of scanning lines produced by the plurality of light scanning units such that the plurality of scanning lines are skewed at an equal angle with respect to a horizontal line, an electrophotographic image forming apparatus including the light scanning unit assembly, and a method of adjusting a scanning line skew.

2. Description of the Related Art

In general, an electrophotographic image forming apparatus scans a beam on a photosensitive medium charged to a predetermined potential to form an electrostatic latent image on an outer circumference thereof, develops the electrostatic latent image as a visual image with a toner that is a developing agent, and transfers and fixes the toner image onto a sheet of paper for printing. Printing a color image using electrophotography typically requires a plurality of developers containing developing agents of different colors. However, depending on the printing method used, the color printing may require one or a plurality of photosensitive media or light scanning units for scanning a beam onto the photosensitive medium.

FIG. 1 is a diagram illustrating a scanning line skew in an electrophotographic image forming apparatus for producing a color image. Referring to FIG. 1, the electrophotographic image forming apparatus includes four photosensitive media 10, 20, 30, and 40 and four light scanning units (not shown) corresponding to the four photosensitive media 10, 20, 30, and 40, respectively. Each of the four light scanning units scan a beam onto the corresponding photosensitive medium 10, 20, 30, or 40 according to an image signal.

Due to dimension errors or assembling tolerances required for mounting the light scanning units on a frame (not shown), scanning lines 11, 21, 31, and 41 produced by the four light scanning units, respectively, are slightly slanted away from a horizontal line extending along the longitudinal direction of the corresponding photosensitive medium 10, 20, 30, or 40. This slight slant away from the horizontal line is referred to as "scanning line skew."

While a skew between each of the scanning lines 11, 21, 31, and 41 and a horizontal line of the corresponding photosensitive medium 10, 20, 30, or 40 falls within a predetermined tolerance, a skew between the respective scanning lines 11, 21, 31, and 41 may fall outside the predetermined tolerance. The presence of skew between the plurality of respective scanning lines 11, 21, 31, and 41 falling outside the predetermined tolerance may cause discrepancies in color superposition at a boundary between images, thus significantly degrading quality of a printed image.

FIG. 2 is a schematic front view illustrating a conventional light scanning unit assembly including a skew adjuster designed in an attempt to overcome the problem described above. Referring to FIG. 2, the conventional light scanning unit assembly includes four light scanning units 50, 60, 70, and 80 arranged in a column-like arrangement and a frame that supports the four light scanning units 50, 60, 70, and 80. Ends of each of the four light scanning units 50, 60, 70, and 80 are propped up by a pair of supports 91 and 92 of the frame 90. As the skew adjuster, the light scanning unit assembly further includes a sloping member 95 interposed between an end of each of the light scanning units 50, 60, 70, and 80 and the support 92. By adjusting a distance between each of the light scanning units 50, 60, 70, and 80 and the respective sloping member 95, the slope of each of the light scanning units 50, 60, 70, and 80 can be adjusted.

However, the conventional light scanning unit has a drawback in that it is difficult to finely adjust the distance between each of the light scanning units 50, 60, 70, and 80 and the respective sloping member 95. Adding another element for fine skew adjustment may complicate the structure of the skew adjuster. Another drawback is that it is difficult to achieve a compact size due to a large width between both sides of the frame 90.

SUMMARY OF THE INVENTION

The present general inventive concept provides a light scanning unit assembly designed with a compact size to facilitate easy adjustment of a scanning line skew and an electrophotographic image forming apparatus including the light scanning unit assembly.

Additional aspects and advantages of the present general inventive concept will be set forth in part in the description which follows and, in part, will be obvious from the description, or may be learned by practice of the general inventive concept.

The foregoing and/or other aspects and advantages of the present general inventive concept are achieved by providing a light scanning unit assembly including a frame, a primary light scanning unit and at least one secondary light scanning unit each being mounted to the frame to scan a corresponding beam, and at least one skew adjuster to adjust a scanning line skew of the at least one secondary light scanning unit to equal a scanning line skew of the primary light scanning unit. The at least one skew adjuster may include at least one side projection to project out from at least one side of the at least one secondary light scanning unit, at least one adjusting screw to connect the at least one side projection with the frame, and at least one elastic member interposed between the at least one side projection and the frame.

The at least one side projection may have a fitting groove into which an end of the at least one elastic member is inserted. The at least one elastic member may comprise at least one spring penetrated by the at least one adjusting screw. At least one stud may be fixed onto the frame and may be inserted into the at least one spring to prevent the at least one spring from bending. The at least one stud may have a female thread formed on an inner circumference thereof to be mated with the at least one adjusting screw. The at least one skew adjuster can further include at least one rear projection to project out from a rear surface of the at least one secondary light scanning unit having a curved side to contact the frame. The at least one rear projection can be elastically biased in a direction in which the curved side contacts the frame. The light scanning unit assembly may include a plurality of secondary light scanning units. The at least one skew adjuster may include a pair of skew adjusters located on both sides of the at least one secondary light scanning unit.

The foregoing and/or other aspects and advantages of the present general inventive concept are also achieved by providing an electrophotographic image forming apparatus including a photosensitive medium on which an electrostatic latent image is formed by scanning a beam thereon and a light scanning unit assembly to scan the beam onto the photosensitive medium. The light scanning unit assembly includes a frame, a primary light scanning unit and at least one secondary light scanning unit each being mounted to the frame to scan a corresponding beam, and at least one skew adjuster to adjust a scanning line skew of the at least one secondary light scanning unit to equal a scanning line skew of the primary light scanning unit. The at least one skew adjuster may include at least one side projection to project out from at least one side of the at least one secondary light scanning unit, at least one adjusting screw to connect the at least one side projection with the frame, and at least one elastic member interposed between the at least one side projection and the frame.

The at least one side projection may have a fitting groove into which an end of the at least one elastic member is inserted. The at least one elastic member may be at least one spring penetrated by the at least one adjusting screw. At least one stud may be fixed onto the frame to be inserted into the at least one spring to prevent the at least one spring from bending. The at least one stud may have a female thread formed on an inner circumference thereof to be mated with the at least one adjusting screw. The at least one skew adjuster can further include at least one rear projection to project out from a rear surface of the at least one secondary light scanning unit having a curved side to contact the frame. The at least one rear projection may be elastically biased in a direction in which the curved side contacts the frame. The light scanning unit assembly may include a plurality of secondary light scanning units. The at least one skew adjuster may include a pair of skew adjusters located on both sides of the at least one secondary light scanning unit.

The foregoing and/or other aspects and advantages of the present general inventive concept are also achieved by providing a method of adjusting a scanning line skew in a light scanning unit assembly including a frame to support one or more secondary scanning units and a corresponding skew adjuster to vertically displace an end of each of the one or more secondary scanning units to adjust a relative skew thereof, the method including scanning test lines for a primary scanning unit and the one or more secondary scanning units, and adjusting skews of the one or more secondary scanning units with respect to a skew of the primary scanning unit according to the scanned test lines by vertically displacing the end of each of the one or more secondary scanning units.

The method may further comprise installing the primary scanning unit and the one or more secondary scanning units on the frame, wherein the installing of the primary scanning unit and one or more secondary scanning units comprises installing the primary scanning unit on a primary shelf of the frame, and installing the one or more secondary scanning units on one or more secondary shelves of the frame.

The scanning of the test lines may comprise scanning a plurality of lines onto one or more photosensitive media, and comparing angles of the plurality of lines with respect to a horizontal axis. The adjusting of the skews of the one or more secondary scanning units may comprise adjusting the angles of test lines scanned by the one or more secondary scanning units with respect to a test line scanned by the primary scanning unit until the skews of the one or more secondary scanning units are within a predetermined tolerance. The adjusting of the skews of the one or more secondary scanning units may comprise controlling the one or more skew adjusters to vertically displace the end of each of the one or more secondary scanning units without horizontally displacing the one or more secondary scanning units. The controlling of the one or more skew adjusters may comprise rotating at least one adjusting screw that is connected to the end of each of the one or more secondary scanning units to drive the end of each of the one or more secondary scanning units closer to the frame or further from the frame.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
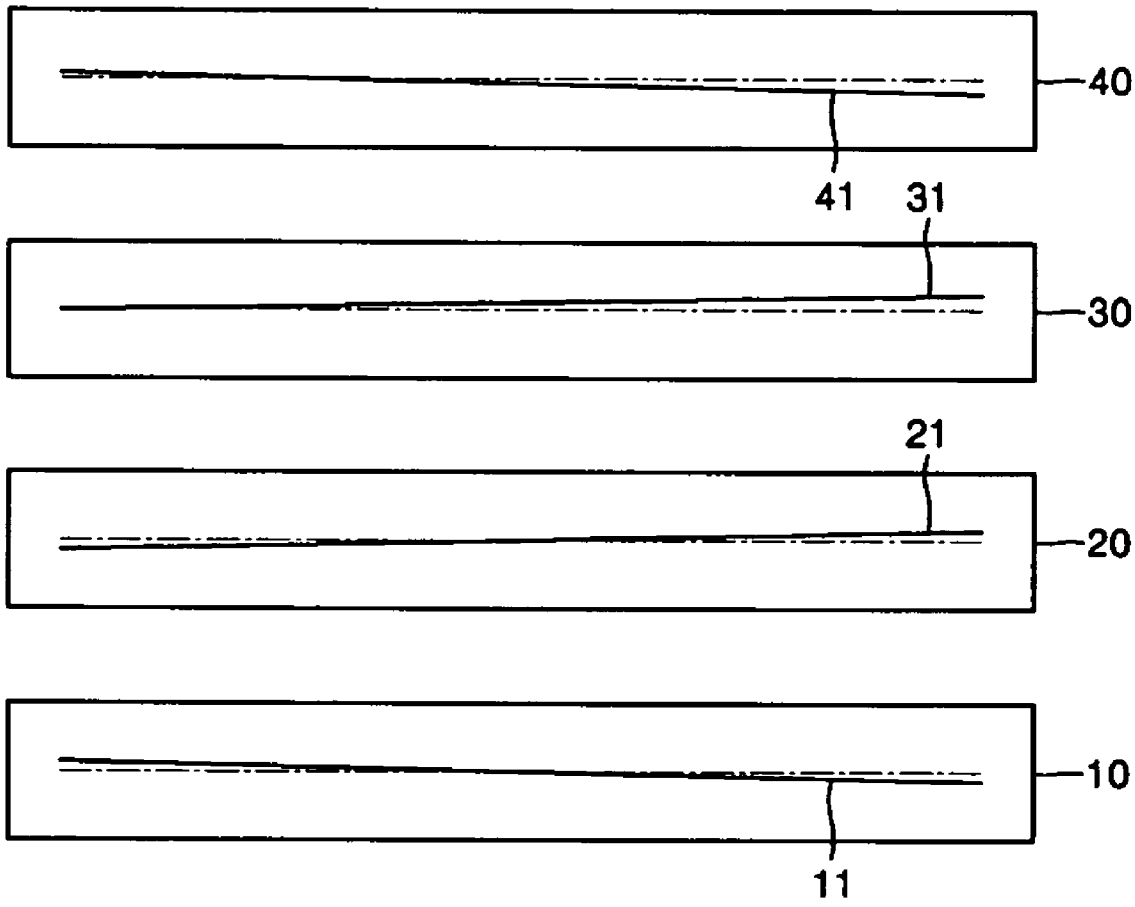
FIG. 1 (PRIOR ART)
FIG. 1 is a diagram illustrating a scanning line skew.
Figure 2:
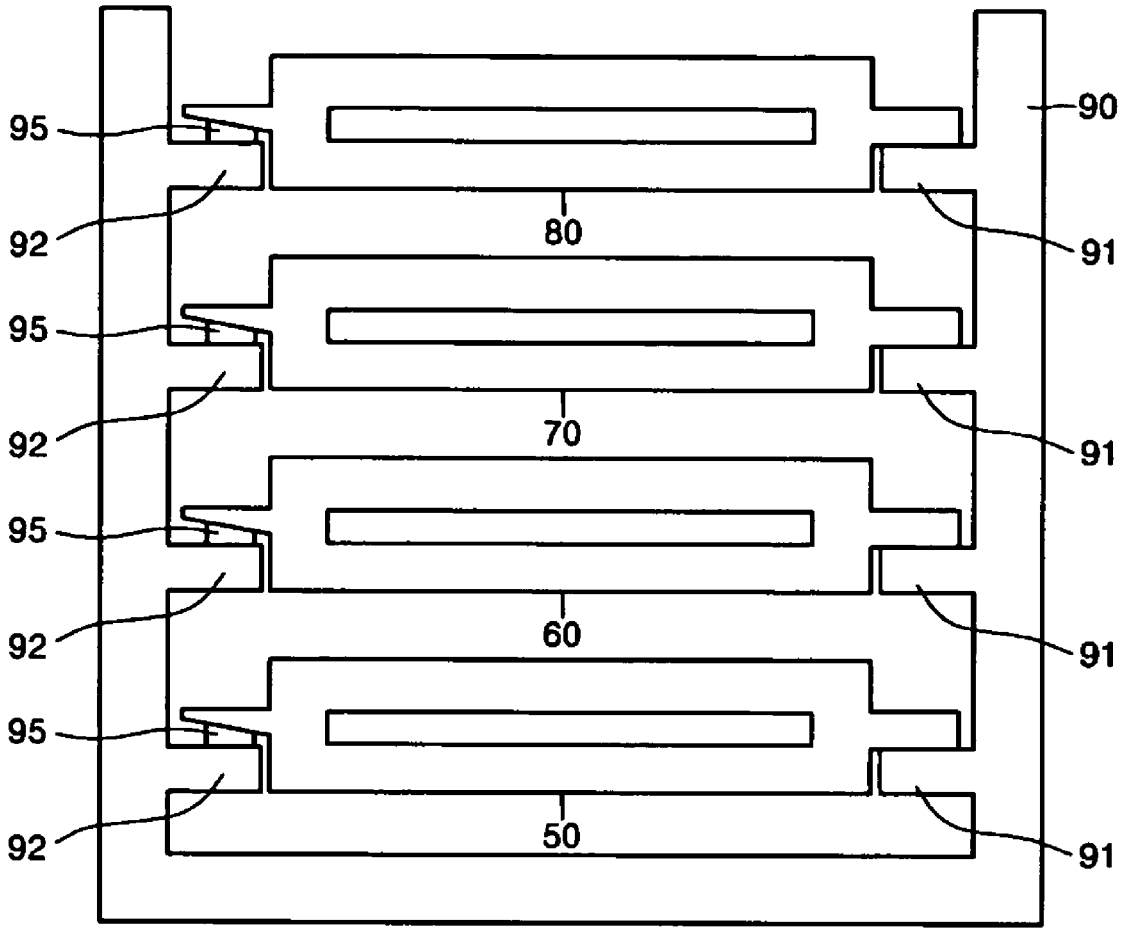
FIG. 2 (PRIOR ART)
FIG. 2 is a schematic front view illustrating a conventional light scanning unit assembly.

A light scanning unit assembly, an electrophotographic image forming apparatus including the light scanning unit assembly, and a method of adjusting a scanning line skew according to embodiments of the present general inventive concept will now be described in detail with reference to the accompanying drawings, wherein like reference numerals refer to like elements throughout.

Figure 3:
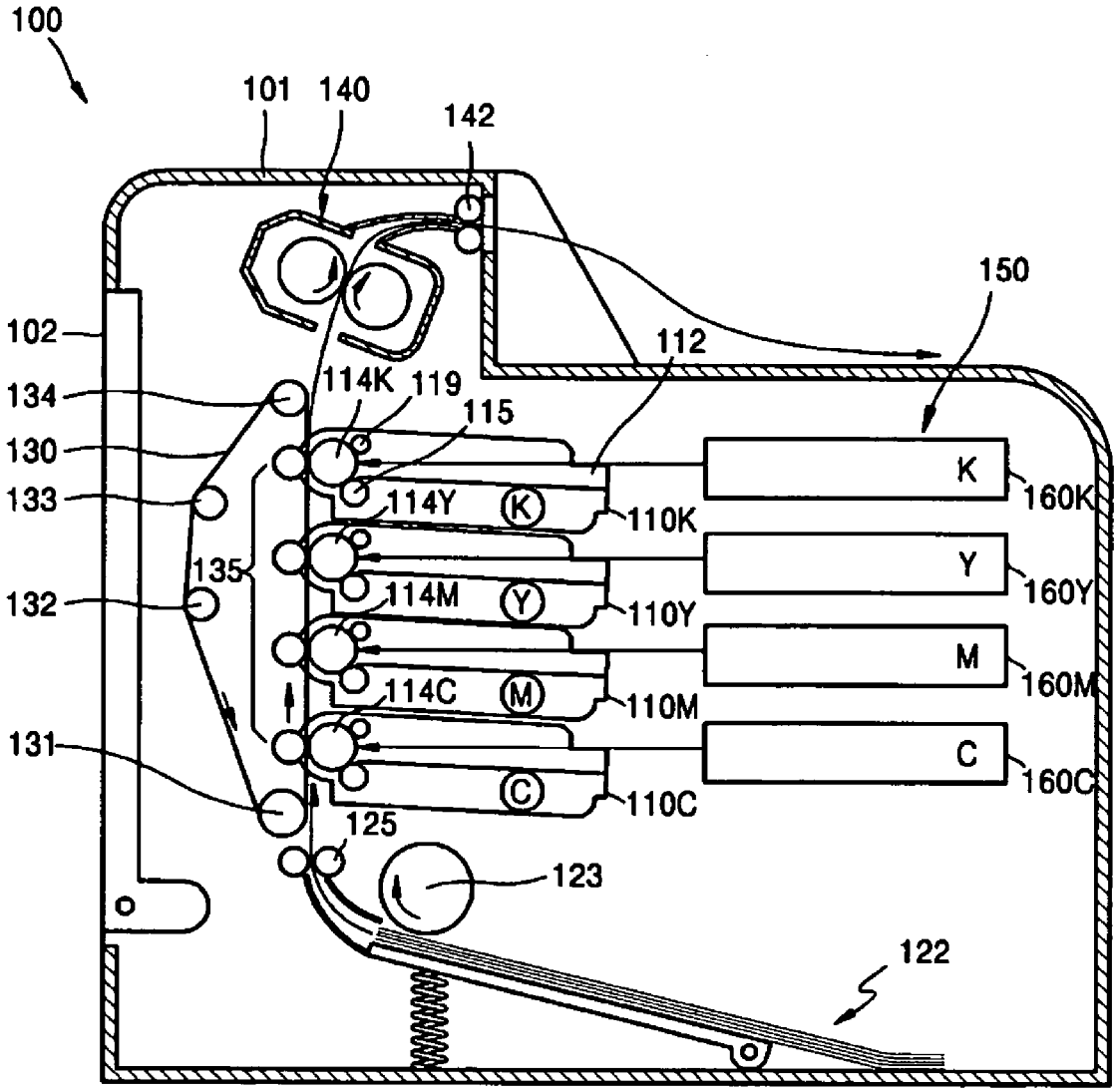
FIG. 3 is a cross-sectional view illustrating an electrophotographic image forming apparatus according to an embodiment of the present general inventive concept.

Referring to FIG. 3, an electrophotographic image forming apparatus 100 comprises an electrophotographic color printer to produce a color image and includes a case 101 having four developers 110C, 110M, 110Y, and 110K and a light scanning unit assembly 150 disposed therein. The light scanning unit assembly 150 includes four light scanning units 160C, 160M, 160Y, and 160K, a transfer belt 130, four transfer rollers 135, and a fixer 140. The electrophotographic image forming apparatus 100 further includes a cassette 122 containing one or more sheets of paper, a pickup roller 123 to pickup up the one or more sheets of paper sheet by sheet from the cassette 122, and a feeding roller 125 to convey a sheet of paper picked up by the pickup roller 123, and a delivery roller 142 to drive a printed paper out of the case 101 after the color image is formed.

The four developers 110C, 110M, 110Y, and 110K comprise cartridges that may need replacement when toner is exhausted. The four developers 110C, 110M, 110Y, and 110K comprise cyan (C) toner, magenta (M) toner, yellow (Y) toner, and black (K) toner, respectively, to produce the color image.

The transfer belt 130 is supported and circulated by a plurality of pulleys 131, 132, 133, and 134. In the present embodiment, the four light scanning units 160C, 160M, 160Y, and 160K have a one-to-one correspondence with the four developers 110C, 110M, 110Y, and 110K, respectively, and scan beams that correspond with image information about CMYK colors onto corresponding photosensitive media 114C, 114M, 114Y, and 114K housed within the four developers 110C, 110M, 110Y, and 110K, respectively. Each of the light scanning units 160C, 160M, 160Y, and 160K to scan a beam includes a laser diode (LD) light source, a beam deflector with a rotating polygon mirror, and an f-θ lens that corrects aberrations in a deflected and scanned beam. Since the structure of the light scanning unit should be readily apparent to those of ordinary skill in the art, a detailed description thereof will not be provided.

The photosensitive media 114C, 114M, 114Y, and 114K face the transfer belt 130 in order to transfer an image. The developers 110C, 110H, 110Y, and 110K each include a charging roller 119 and a developing roller 115. A charging bias is applied to each charging roller 119 to charge an outer circumference of each of the respective photosensitive media 114C, 114M, 114Y, and 114K to a uniform potential. A developing bias applied to the developing roller 115 that attracts toner particles causes the toner particles to adhere to the photosensitive media 114C, 114M, 114Y, and 114K.

Although not illustrated, each of the photosensitive media 114C, 114M, 114Y, and 114K further includes a supplying roller to supply toner to the corresponding developing roller 115, a doctor blade to regulate an amount of toner on the corresponding developing roller 115, and a conveyor belt type agitator to convey toner to the corresponding supplying roller. As illustrated in FIG. 3, each of the developers 110C, 11M, 110Y, and 110K has an opening 112 through which each of the corresponding light scanning units 160C, 160M, 160Y, and 160K scans a beam onto each of the corresponding photosensitive media 114C, 114M, 114Y, and 114K, respectively.

The four transfer rollers 135 are each disposed to face the respective photosensitive media 114C, 114M, 114Y, and 114K, with the transfer belt 130 interposed therebetween. A transfer bias is applied to each of the four transfer rollers 135.

A process of producing a color image in the electrophotographic image forming apparatus 100 of FIG. 3 will now be described. Each of the photosensitive media 114C, 114M, 114Y, and 114K is charged to a uniform potential by the charging bias applied to the charging roller 119. Each of the four light scanning units 160C, 160M, 160Y, and 160K scan a beam that corresponds with the image information about each of CMYK colors onto the corresponding photosensitive media 114C, 114M, 114Y, or 114K through the opening 112, such that an electrostatic latent image is formed on the photosensitive media 114C, 114M, 114Y, or 114K.

The developing bias applied to the developing roller 115 causes toner to be attracted from the developing roller 115 to each of the photosensitive media 114C, 114M, 114Y, and 114K to develop the electrostatic latent image into a visual image including the CMYK colors on the photosensitive media 114C, 114M, 114Y, or 114K.

A sheet of paper is picked up from the cassette 122 by the pickup roller 123 and is fed to the transfer belt 130 by the feeding roller 125. The sheet of paper is attracted to the surface of the transfer belt 130 by an electrostatic force and is conveyed at the same velocity as a circulation speed of the transfer belt 130.

When a front end of a visual cyan (C) image formed on the photosensitive medium 114C within the lowermost developer 110C reaches a nip between the transfer roller 135 and the photosensitive media 114C, a front end of the sheet of paper, which is attracted to the transfer belt 130, passes through the nip. At this time, the visual cyan (C) image formed on the photosensitive medium 114C is transferred to the sheet of paper by a transfer bias applied to the transfer roller 135. As the sheet of paper is continuously conveyed, visual magenta (M), yellow (Y), and black (K) images formed on the remaining photosensitive media 114M, 114Y, 114K are sequentially superposed and transferred onto the same sheet of paper to form a visual color image. The fixer 140 fixes the visual color image to the sheet of paper by applying heat and pressure. The delivery roller 142 then drives the sheet of paper having the visual color image printed thereon out of the case 101.

The four light scanning units 160C, 160M, 160Y, and 160K in the light scanning unit assembly 150 should make a scanning line skew equal to one another in order to suppress discrepancies in superposition of the CMYK colors.

Figure 4:
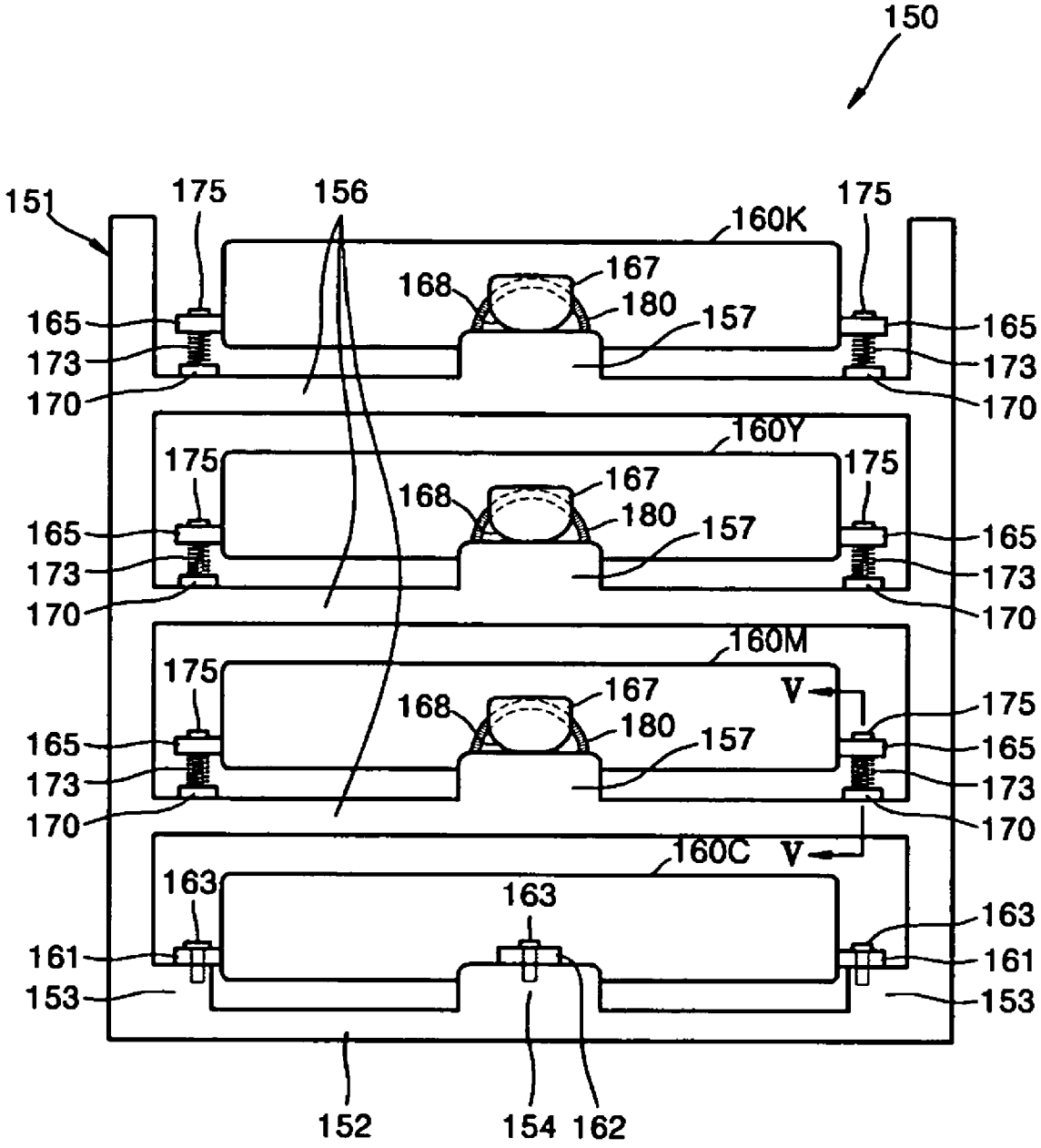
FIG. 4 is a rear view illustrating a light scanning unit assembly according to an embodiment of the present general inventive concept.

FIG. 4 is a rear view illustrating the light scanning unit assembly 150 (same as FIG. 3) according to an embodiment of the present general inventive concept. Referring to FIG. 4, the light scanning unit assembly 150 includes four light scanning units 160C, 160M, 160Y, and 160K (same as FIG. 3) and a frame 151 on which the four light scanning units 160C, 160M, 160Y, and 160K are mounted in a column-like arrangement. A lowermost light scanning unit 160C is hereinafter referred to as "a primary light scanning unit" while the remaining three light scanning units 160M, 160Y, and 160K having scanning line skews that are adjusted with respect to a scanning line skew of the primary light scanning unit 160C are hereinafter referred to as "secondary light scanning units." In other words, skews of scanning lines produced by the secondary light scanning units 160M, 160Y, and 160K are adjusted to be equal to a skew of the scanning line produced by the light scanning unit 160C mounted at the lowermost position of the frame 151.

The frame 151 includes a primary shelf 152 and three equally spaced secondary shelves 156 mounted above the primary shelf 152. A pair of side projections 161 projecting out from each of the sides of the primary light scanning unit 160C are respectively fastened to a pair of side supports 153 in the primary shelf 152 with clamping screws 163. Additionally, a rear projection 162 projecting out from a rear surface of the primary light scanning unit 160C is engaged to a rear support 154 in the primary shelf 152 with one of the clamping screws 163. Accordingly, the primary light scanning unit 160C is fixed to the primary shelf 152.

The light scanning unit assembly 150 further includes skew adjusters to respectively mount the secondary light scanning units 160M, 160Y, and 160K on the secondary shelves 156 in such a manner as to be able to adjust their respective scanning line skews. By manipulating the skew adjusters, the scanning line skews of the secondary light scanning units 160M, 160Y, and 160K can be adjusted to be equal with respect to the scanning line skew of the primary light scanning unit 160C within a predetermined skew tolerance Each of the skew adjusters includes a pair of side projections 165 projecting out from each of the sides of each of the secondary light scanning units 160M, 160Y, and 160K, a first spring 173 interposed between each of the side projections 165 and a corresponding side of the secondary shelf 156. An adjusting screw 175 is disposed to penetrate the first spring 173 and to connect the corresponding side projection 165 with the secondary shelf 156. Although FIG. 4 illustrates that the secondary light scanning units 160M, 160Y, and 160K include the side projections 165, the first springs 173, and the adjusting screws 175 of the skew adjusters with respect to both sides of the secondary shelves 156, the light scanning unit assembly 150 of the present general inventive concept may alternatively include the skew adjusters disposed on a single side of the secondary light scanning units 160M, 160Y, and 160K. For example, one side of the secondary light scanning units 160M, 160Y, and 160K may be fixed to the secondary shelves 156 and the other side may be adjustable with respect to the secondary shelves 156 by a corresponding skew adjuster.

Figure 5:
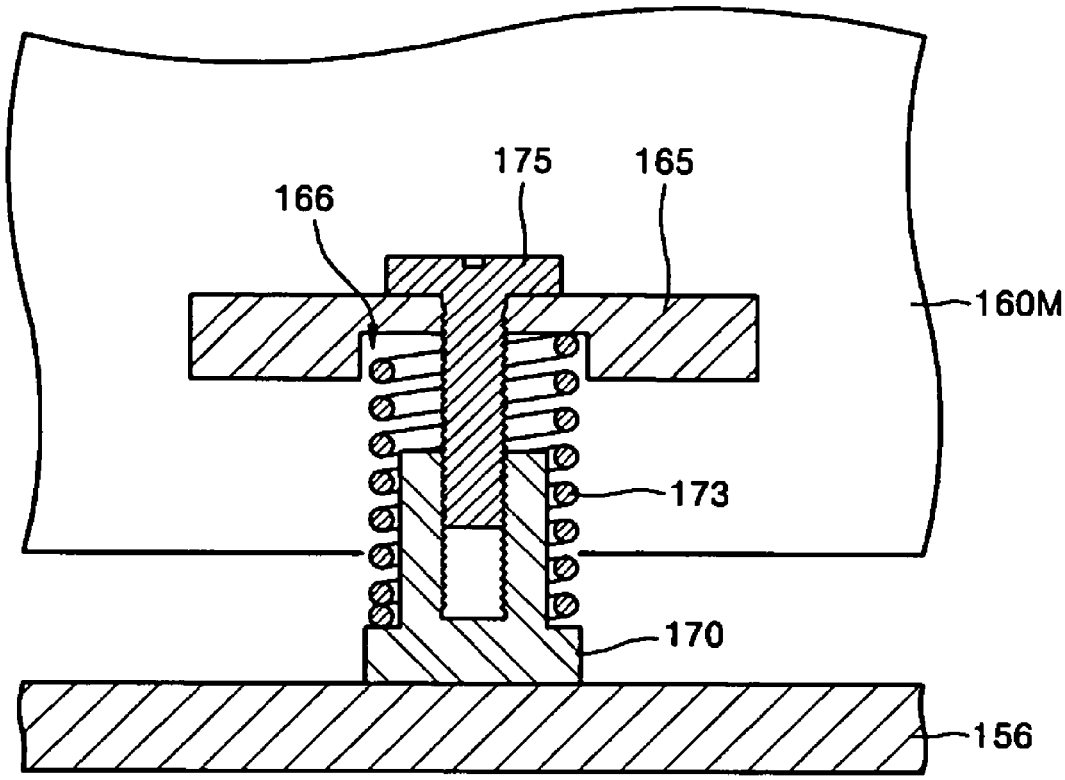
FIG. 5 is a cross-sectional view taken along line V-V of the light scanning unit assembly of FIG. 4.

FIG. 5 is a cross-sectional view taken along line V-V of the light scanning unit assembly 150 of FIG. 4. Referring to FIG. 5, the side projection 165 of the secondary light scanning unit 160M has a spring fitting groove 166 in a bottom surface, into which a top end of the first spring 173 is inserted to ease assembly. A stud 170 is fixed onto the secondary shelf 156 and is inserted into the first spring 173 to prevent the first spring 173 from bending during elastic contraction and recovery.

A female thread is formed on an inner circumference of the stud 170 to mate with the adjusting screw 175. As the adjusting screw 175 rotates clockwise (or counterclockwise), the side projection 165 and a corresponding side of the secondary light scanning unit 160M slightly moves down or up accordingly. While FIG. 5 only illustrates a cross-section of the skew adjuster located on one side of the secondary light scanning unit 160M directly overlying the primary light scanning unit 160C, the skew adjusters located on the other side of the secondary light scanning unit 160M and on one or both sides of the other two secondary light scanning units 160Y and 160K are structured in a similar manner.

Referring back to FIG. 4, the light scanning unit assembly 150 further includes a rear projection 167 projecting out from a rear surface of each of the secondary light scanning units 160M, 160Y, and 160K and supportably contacting a corresponding rear support 157 on the secondary shelf 156. The rear projection 167 has a curved bottom 168 to contact the corresponding rear support 157. Both ends of a second spring 180 wound around the rear projection 167 are fastened into the rear support 157 so that the rear projection 167 is elastically biased in a direction in which the rear projection 167 contacts the rear support 157.

Each of the secondary light scanning units 160M, 160Y, and 160K are separated from the secondary shelf 156 by the skew adjusters. When the corresponding adjusting screw 175 rotates, the slope of each light scanning unit 160M, 160Y, or 160K is adjusted. The curved bottom 168 of the rear projection 167 enables each of the secondary light scanning units 160M, 160Y, and 160K to slant.

A method of adjusting a scanning line skew according to an embodiment of the present general inventive concept will now be described with reference to FIGS. 4 and 6-8. After fixing the primary light scanning unit 160C to the frame 151, a first secondary light scanning unit 160M is mounted such that the skew adjusters of the first secondary light scanning unit 160M are located on both sides and at the rear thereof. The primary light scanning unit 160C and the first secondary light scanning unit 160M each respectively scan test beams onto corresponding photosensitive media 114C and 114M in order to identify skews of a reference scanning line $S_C$ and a first scanning line $S_M$ (see FIG. 6).

Figure 6:
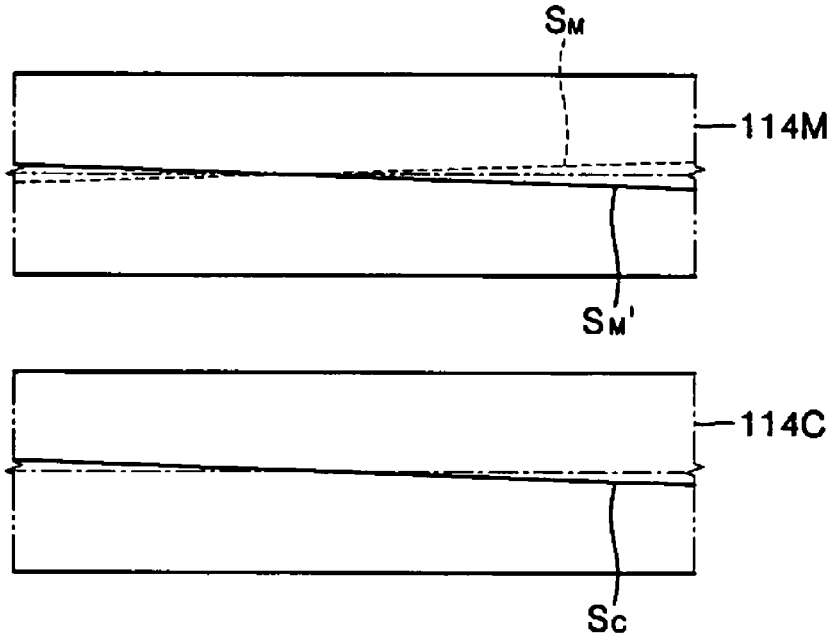
FIGS. 6 through 8 are diagrams illustrating a method of adjusting a scanning line skew according to an embodiment of the present general inventive concept.

Referring to FIG. 6, when the skew of the first scanning line $S_M$ produced by the first secondary light scanning unit 160M does not coincide with the skew of the reference scanning line $S_C$ produced by the primary light scanning unit 160C, a slope of the first secondary light scanning unit 160M is adjusted by rotating a pair of adjusting screws 175 engaged into both the side projections 165 of the first secondary light scanning unit 160M clockwise or counterclockwise. When the adjusting screws 175 are rotated by a proper angle and in a proper direction, the first scanning line $S_M$ is adjusted to a first adjusted scanning line $S_M'$ that has a skew equal to that of the reference scanning line $S_C$ within the predetermined tolerance.

After mounting a second secondary light scanning unit 160Y to the frame 151 above the first secondary light scanning unit 160M, the second secondary light scanning unit 160Y scans a test beam to the corresponding photosensitive medium 114Y in order to compare a skew of a second scanning line $S_Y$ produced by the second secondary light scanning unit 160Y with the skew of the reference scanning line $S_C$ produced by the primary light scanning unit 160C.

Figure 7:
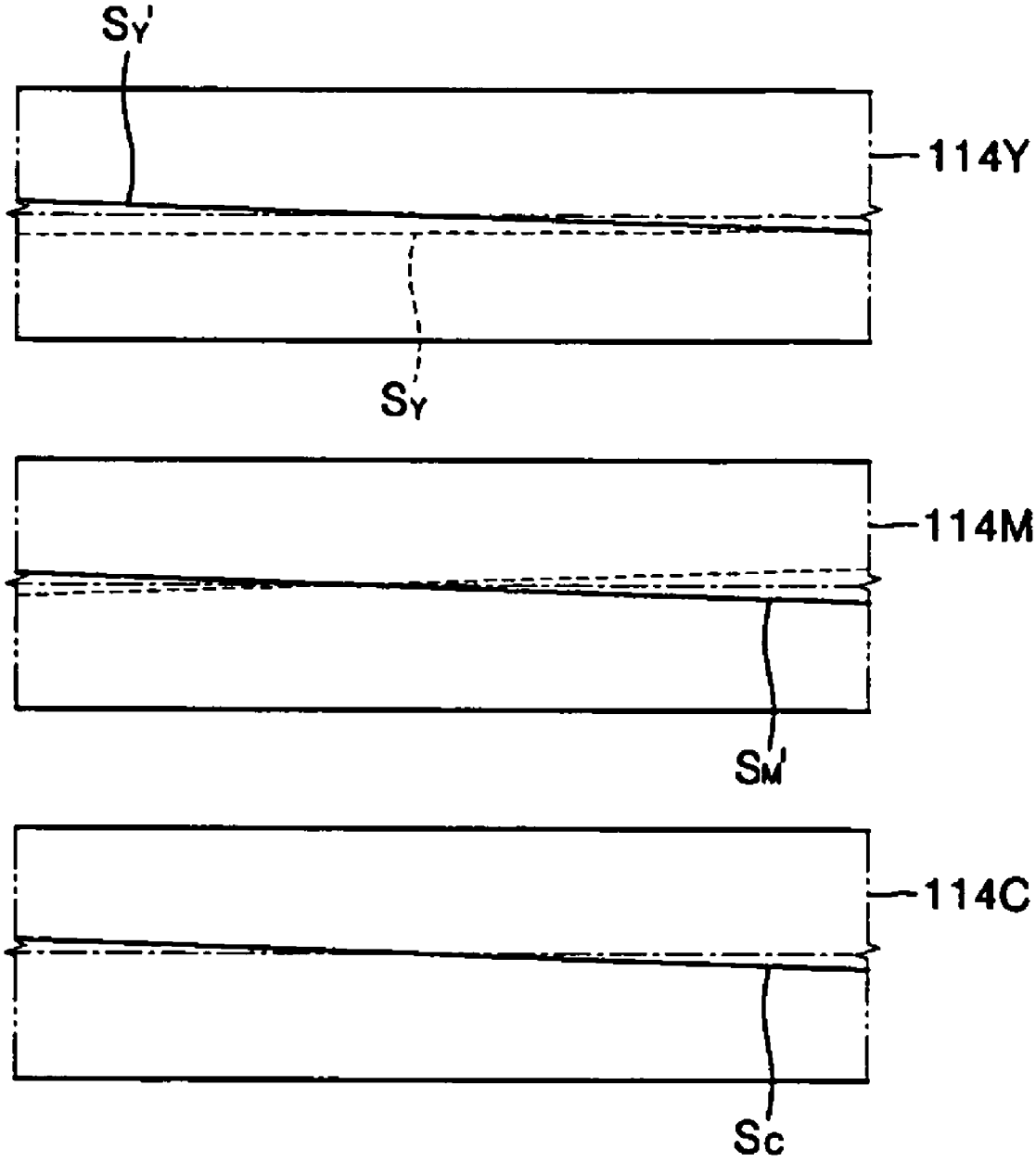

Referring to FIG. 7, when the skew of the second scanning line $S_Y$ does not coincide with the skew of the reference scanning line $S_C$, the second scanning line $S_Y$ can be adjusted to a second adjusted scanning line $S_Y'$ having a skew that is equal to the skew of the reference scanning line $S_C$ within the predetermined tolerance by rotating a pair of adjusting screws 175 engaged to both side projections 165 of the second secondary light scanning unit 160Y clockwise or counterclockwise by a proper angle and proper direction.

After mounting a third secondary light scanning unit 160K to the frame 151 above the second secondary light scanning unit 160Y, the third secondary light scanning unit 160K scans a test beam to the corresponding photosensitive medium 114K in order to compare a skew of a third scanning line $S_K$ produced by the third secondary light scanning unit 160K with the skew of the reference scanning line $S_C$ produced by the primary light scanning unit 160C.

Figure 8:
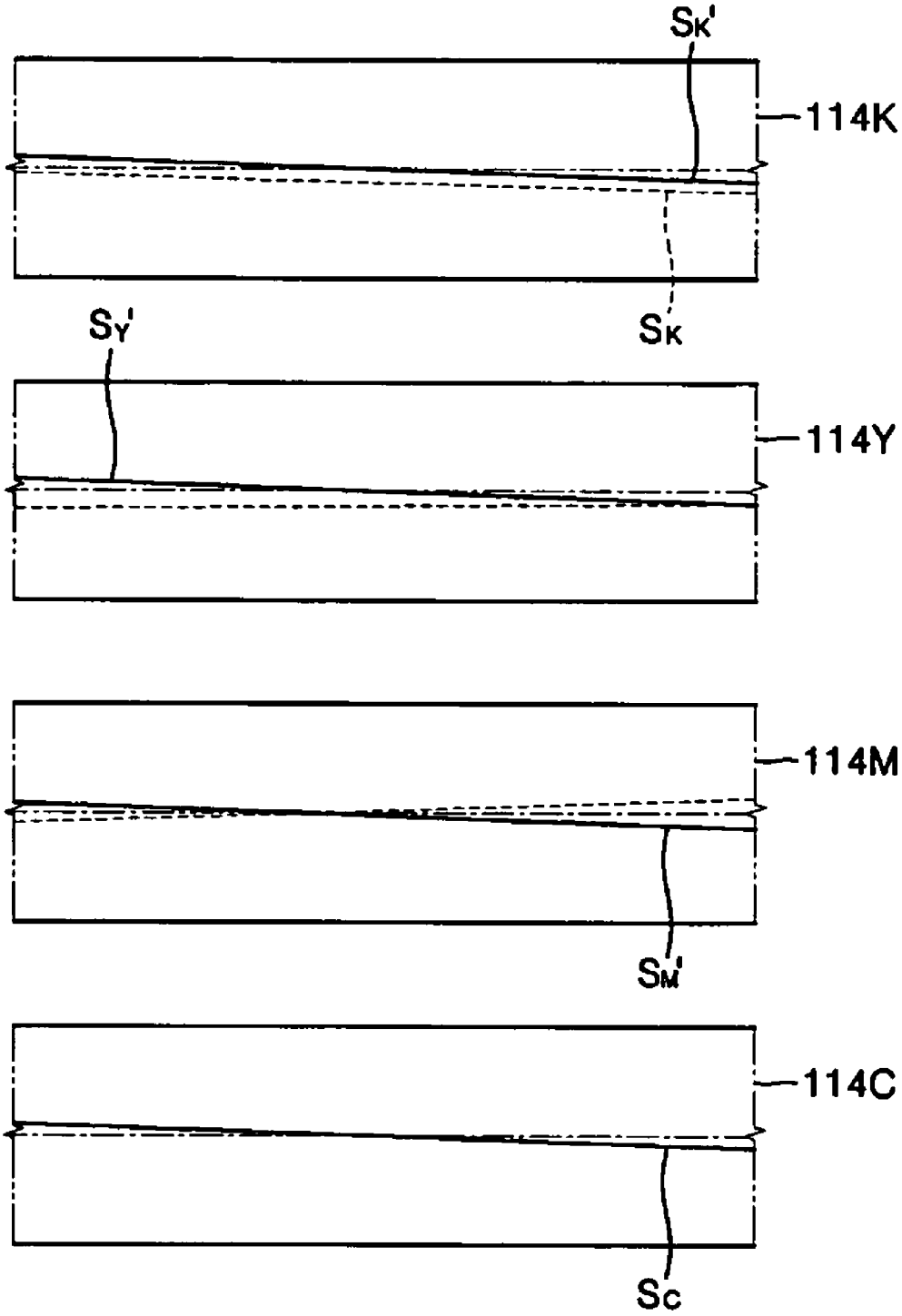

Referring to FIG. 8, when the skew of the third scanning line $S_K$ does not coincide with the skew of the reference scanning line $S_C$, the third scanning line $S_K$ can be adjusted to a third adjusted scanning line $S_K'$ that has a skew equal to that of the reference scanning line $S_C$ within the predetermined tolerance by rotating a pair of adjusting screws 175 engaged into both the side projections 165 of the third secondary light scanning unit 160K clockwise or counterclockwise by a proper angle and proper direction.

A light scanning unit assembly having a plurality of light scanning units and a method of adjusting a scanning line skew according to the present general inventive concept easily eliminates a difference between skews of scanning lines produced by the plurality of light scanning units, thereby improving quality of a printed image. Although the present general inventive concept is described as having four light scanning units to scan lines that correspond with different colors in a color image onto corresponding photosensitive media, it should be understood that other arrangements of light scanning units may alternatively be used with the present general inventive concept. For example, a light scanning unit assembly may have more or less than four light scanning units and/or the light scanning units may not have a one to one correspondence with the photosensitive media.

The light scanning unit assembly of the present general inventive concept eliminates a need for a sloping member that horizontally moves to adjust skew unlike a conventional light scanning unit assembly, thereby reducing a size of the light scanning unit assembly. Therefore, it is easy to achieve an electrophotographic image forming apparatus with a compact design.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A light scanning unit assembly, comprising:

a frame;

a primary light scanning unit and at least one secondary light scanning unit each being mounted to the frame to scan a corresponding beam; and at least one skew adjuster to adjust a scanning line skew of the at least one secondary light scanning unit to equal a scanning line skew of the primary light scanning unit, the at least one skew adjuster comprising:

at least one side projection to project out from at least one side of the at least one secondary light scanning unit, at least one adjusting screw to connect the at least one side projection with the frame, and at least one elastic member interposed between the at least one side projection and the frame.

2. The assembly of claim 1, wherein the at least one side projection comprises a fitting groove into which an end of the at least one elastic member is inserted.

3. The assembly of claim 1, wherein the at least one elastic member comprises at least one spring penetrated by the at least one adjusting screws.

4. The assembly of claim 3, wherein the frame comprises at least one stud fixed thereon to be inserted into the at least one spring to prevent bending of the at least one spring and the at least one stud has a female thread formed on an inner circumference thereof to be mated with the at least one adjusting screw.

5. The assembly of claim 1, wherein the at least one skew adjuster further comprises:

at least one rear projection to project out from a rear surface of the at least one secondary light scanning unit having a curved side to contact the frame, and the at least one rear projection is elastically biased in a direction in which the curved side contacts the frame.

6. The assembly of claim 1, wherein the at least one secondary light scanning unit comprises two or more secondary scanning units.

7. The assembly of claim 1, wherein the at least one skew adjuster comprises a pair of the skew adjusters located on both sides of the at least one secondary light scanning unit.

8. A light scanning unit assembly, comprising:

a frame to support one or more scanning units including a primary shelf to support a primary scanning unit in a fixed state, and at least one secondary shelf to support at least one secondary scanning unit; and at least one skew adjuster disposed on the at least one secondary shelf to vertically displace an end of the supported at least one secondary scanning unit to adjust a relative skew of the supported at least one secondary scanning unit.

9. The light scanning unit assembly of claim 8, wherein the at least one skew adjuster comprises a skew adjuster disposed at each of opposite ends of the at least one secondary shelf to vertically displace opposite ends of the respective supported at least one secondary scanning unit.

10. The light scanning unit assembly of claim 8, wherein the relative skew of the supported at least one secondary scanning unit is adjusted with respect to the supported primary scanning unit.

11. The light scanning unit assembly of claim 8, wherein:

the primary scanning unit disposed on the primary shelf to scan a beam having first image information; and the at least one secondary scanning unit disposed on the at least one secondary shelf above the primary shelf to scan a beam having second image information.

12. The light scanning unit assembly of claim 11, wherein the at least one skew adjuster comprises a skew adjuster disposed on each of opposite sides of the at least one secondary scanning unit and are each independently movable to adjust the relative skew of the respective at least one secondary scanning unit with respect to the primary scanning unit.

13. The light scanning unit assembly of claim 12, wherein the relative skew of the at least one secondary scanning unit with respect to the primary scanning unit is adjusted according to a reference scanning line produced by the primary scanning unit and a scanning line produced by the at least one secondary scanning unit.

14. The light scanning unit assembly of claim 11, wherein:

the at least one secondary shelf includes a rear support part; and the at least one secondary scanning unit includes a rear projection to contact the rear support part and having a curved surface to enable the relative skew of the at least one secondary scanning unit to be adjusted.

15. A skew adjuster usable with a light scanning unit assembly having a support frame, the skew adjuster usable to adjust a skew of a secondary scanning unit relative to one of a horizontal axis and a reference scanning unit, and comprising:

a projection extending from at least one end of the secondary scanning unit;

an adjusting screw to adjustably connect the projection to the support frame; and an elastic member interposed between the projection and the support frame, wherein the projection comprises a fitting groove into which the elastic member is inserted.

16. The skew adjuster of claim 15, wherein the elastic member comprises a spring, and the skew adjuster further comprises:

a stud fixed to the support frame to extend through the spring and prevent the spring from bending when the spring contracts and expands.

17. The skew adjuster of claim 16, wherein the stud comprises a female screw mating part along an inner circumference thereof to be mated with the adjusting screw.

18. The skew adjuster of claim 16, wherein the projection comprises a first projection extending from a first end of the secondary scanning unit and a second projection extending from a second end of the secondary scanning unit opposite the first end of the secondary scanning unit.

19. The skew adjuster of claim 15, wherein the projection is vertically movable with respect to a horizontal axis by rotating the adjusting screw.

20. The skew adjuster of claim 19, wherein the elastic member exerts a recovery force on the projection.

21. An electrophotographic image forming apparatus including a photosensitive medium on which an electrostatic latent image is formed by scanning a beam thereon and a light scanning unit assembly to scan the beam onto the photosensitive medium, comprising:

a light scanning unit assembly, comprising:

a frame;

a primary light scanning unit and at least one secondary light scanning unit each being mounted to the frame to scan a corresponding beam; and a skew adjuster associated with each secondary light scanning unit to make a respective scanning line skew equal to a scanning line skew of the primary light scanning unit, and each skew adjuster comprising:

a side projection to project out from at least one side of the respective secondary light scanning unit, an adjusting screw to connect the respective side projection with the frame, and an elastic member interposed between the respective side projection and the frame.

22. The apparatus of claim 21, wherein the side projection includes a fitting groove into which an end of the elastic member is inserted.

23. The apparatus of claim 21, wherein the elastic member comprises a spring penetrated by the adjusting screw.

24. The apparatus of claim 23, wherein the frame comprises a stud fixed thereon corresponding to the side projection and to be inserted into the spring to prevent bending of the spring, the stud having a female thread formed on an inner circumference thereof to be mated with the adjusting screw.

25. The apparatus of claim 21, wherein the skew adjuster further comprises:

a rear projection to project out from a rear surface of the associated secondary light scanning unit, the rear projection having a curved side to contact the frame and to be elastically biased in a direction in which the curved side contacts the frame.

26. The apparatus of claim 21, wherein the at least one secondary light scanning unit comprises two or more secondary light scanning units.

27. The apparatus of claim 21, wherein each associated skew adjuster comprises a pair of skew adjusters, the pair of skew adjusters located on opposite sides of the associated secondary light scanning unit with respect to each other.

28. An electrophotographic image forming apparatus, comprising:

two or more photosensitive media to receive image information and to transfer the image information to a sheet of paper; and a light scanning unit assembly adjacent to the two or more photosensitive media, and comprising:

a frame;

a primary scanning unit disposed on the frame to scan a first line on a first one of the two or more photosensitive media;

at least one secondary scanning unit disposed on the frame to scan a second line on another one of the two or more photosensitive media; and at least one skew adjuster disposed on the frame and attached to an end of each of the at least one secondary scanning unit to vertically move the attached end to adjust a skew of the secondary scanning unit relative to the primary scanning unit, wherein the skew adjuster comprises:

at least one side projection to project out from at least one side of the at least one secondary light scanning unit;

at least one adjusting screw to connect the at least one side projection with the frame; and at least one elastic member interposed between the at least one side projection and the frame.

29. The apparatus of claim 28, wherein a number of photosensitive media is equal to a number of scanning units.

30. The apparatus of claim 28, wherein the first line corresponds to information about a first color in a color image and the second line corresponds to information about a second color in the color image.

31. The apparatus of claim 28, wherein the primary scanning unit and the at least one secondary scanning unit are horizontally fixed to the frame.

32. The apparatus of claim 28, wherein the frame comprises a plurality of shelves in a column arrangement.

33. The apparatus of claim 28, wherein the skew adjuster comprises a first skew adjuster disposed on a first end of the corresponding secondary scanning unit and a second skew adjuster disposed on a second end of the corresponding secondary scanning unit, the first and second skew adjusters to vertically move the first and second ends of the corresponding secondary scanning unit independent of each other.

34. A method of adjusting a scanning line skew in a light scanning unit assembly including a frame to support one or more secondary scanning units and a corresponding skew adjuster to vertically displace an end of each of the one or more secondary scanning units to adjust a relative skew thereof, the method comprising:

scanning test lines for a primary scanning unit and the one or more secondary scanning units; and adjusting skews of the one or more secondary scanning units with respect to a skew of the primary scanning unit according to the scanned test lines by vertically displacing the end of each of the one or more secondary scanning units.

35. The method of claim 34, further comprising:

installing the primary scanning unit and the one or more secondary scanning units on the frame.

36. The method of claim 35, wherein the installing of the primary scanning unit and one or more secondary scanning units comprises:

installing the primary scanning unit on a primary shelf of the frame; and installing the one or more secondary scanning units on one or more secondary shelves of the frame.

37. The method of claim 34, wherein the scanning of the test lines comprises:

scanning a plurality of lines onto one or more photosensitive media; and comparing angles of the plurality of lines with respect to a horizontal axis.

38. The method of claim 37, wherein the adjusting of the skews of the one or more secondary scanning units comprises:

adjusting the angles of test lines scanned by the one or more secondary scanning units with respect to a test line scanned by the primary scanning unit until the skews of the one or more secondary scanning units are within a predetermined tolerance.

39. The method of claim 34, wherein the adjusting of the skews of the one or more secondary scanning units comprises:

controlling the corresponding skew adjuster to vertically displace the end of each of the one or more secondary scanning units without horizontally displacing the one or more secondary scanning units.

40. The method of claim 39, wherein the controlling of the corresponding skew adjuster comprises rotating at least one adjusting screw that is connected to the end of each of the one or more secondary scanning units to drive the end of each of the one or more secondary scanning units closer to the frame or further from the frame.

* * * * *